US006713121B2

(12) United States Patent
Sakaguchi et al.

(10) Patent No.: US 6,713,121 B2
(45) Date of Patent: Mar. 30, 2004

(54) CATHODE RAY TUBE AND METHOD FOR MANUFACTURING THEREOF

(75) Inventors: Kimiyo Sakaguchi, Aichi (JP); Hideaki Inoue, Gifu (JP); Tetsuo Watanabe, Kanagawa (JP)

(73) Assignee: Sony Corporation (JP)

( * ) Notice: Subject to any disclaimer, the term of this patent is extended or adjusted under 35 U.S.C. 154(b) by 279 days.

(21) Appl. No.: 09/897,471

(22) Filed: Jul. 3, 2001

(65) Prior Publication Data

US 2002/0024292 A1 Feb. 28, 2002

(30) Foreign Application Priority Data

Jul. 5, 2000 (JP) ..... P2000-203920

(51) Int. Cl.[7] ..... B05D 5/12
(52) U.S. Cl. ..... 427/64; 427/69
(58) Field of Search ..... 427/64, 69; 313/466

(56) References Cited

U.S. PATENT DOCUMENTS 3,692,576 A * 9/1972 Takayanagi ..... 428/610
3,703,401 A * 11/1972 Deal ..... 427/68

FOREIGN PATENT DOCUMENTS

| | | |
|---|---|---|
| DE | 28 00 198 | 7/1978 |
| EP | 61135021 | 6/1986 |
| EP | 11096908 | 4/1999 |
| EP | 1 052 669 | 11/2000 |

* cited by examiner

*Primary Examiner*—Shrive P. Beck
*Assistant Examiner*—Michael Cleveland
(74) *Attorney, Agent, or Firm*—Rader, Fishman & Grauer PLLC; Ronald P. Kananen

(57) ABSTRACT

The present invention discloses a method for manufacturing a cathode ray tube capable of forming on an inner surface side of a panel a conductive reflective film and a heat absorbing film, both being excellent in the characteristics and the film qualities thereof, which comprises a first step for forming on a fluorescent film preliminarily formed on the inner surface of a panel a conductive reflective film by depositing aluminum by the vacuum evaporation process; a second step for forming a diffusion preventive film made of aluminum oxide on the surface of the conductive reflective film; and a third step for forming a heat absorbing film on the diffusion preventive film by depositing chromium by the vacuum evaporation process.

6 Claims, 4 Drawing Sheets

CATHODE RAY TUBE AND METHOD FOR MANUFACTURING THEREOF

CROSS REFERENCES TO RELATED APPLICATIONS

The present document is based on Japanese Priority Document JP 2000-203920, filed in the Japanese Patent Office on Jul. 5, 2000, the entire contents of which are incorporated herein by reference.

BACKGROUND OF THE INVENTION

1. Field of the Invention

The present invention relates to a cathode ray tube and a method for manufacturing thereof, and in particular to a technology preferably applicable to a cathode ray tube having on the inner surface side of a panel a conductive reflective film (metal back film) for enhancing the luminous intensity of the fluorescent material and a heat absorbing film for reducing the landing failure of the electron beam due to thermal expansion of a color selective mask.

2. Description of the Related Art

It is a general practice in a method of manufacturing cathode ray tube, in particular, in a method for manufacturing the panel therefor, that a fluorescent film is formed on an inner surface of the panel, and an aluminum conductive reflective film is then formed thereon. The fluorescent film is obtained by forming red, green and blue fluorescent material layers based on predetermined patterns at predetermined positions defined by a black matrix film (carbon film) patterned on the inner surface of the panel, the surface of which is then smoothened by an intermediate layer (filming layer) formed thereon. The conductive reflective film is obtained by vapor depositing an aluminum film by the vacuum vapor deposition process on the inner surface side of the panel already having such fluorescent film formed thereon. The fluorescent film 2 and the conductive reflective film 3 are thus formed on the inner surface side of the panel 1 as shown in FIG. 1.

In a general constitution of a color cathode ray tube, three electron beams emitted from electron beam guns are landed onto the fluorescent material layers of corresponding colors after being individually directed by a color selective mask (aperture grill, shadow mask, and the like). The color selective mask is then heated while being directly irradiated by the electron beams and is further heated by heat radiated therefrom and reflected by the conductive reflective film. This results in a considerable heat expansion of the color selective mask, which is causative of landing failure (positional deflection of the electron beams onto the fluorescent material layers) and undesirable color misalignment.

A known technique for reducing such landing failure of the electron beams is to form a heat absorbing film on the conductive reflective film on the inner surface side of the panel so as to absorb the radiation heat from the color selective mask, thereby suppressing the thermal expansion of such color selective mask.

In a conventional process, the heat absorbing film is formed after the conductive reflective film is formed by vapor-depositing aluminum onto the inner surface side of the panel. More specifically, known methods include spraying graphite dissolved in a solvent to the inner surface side of the panel having a conductive reflective film already formed thereon to thereby form a heat absorbing film; vapor-depositing aluminum under a low degree of vacuum to thereby form a heat absorbing film made of aluminum oxide (alumina); and vapor-depositing a blackening material other than aluminum (manganese, tin, and the like) to thereby form the heat absorbing film.

The conventional manufacturing methods as described above have however been disadvantageous in that requiring two separate film forming steps for forming conductive reflective film and the heat absorbing film on the inner surface side of the panel complicates the manufacturing process of a cathode ray tube (panel manufacturing process). In the case of using a single vacuum chamber for vacuum evaporation of the conductive reflective film and the heat absorbing film in order to simplify the manufacturing process undesirably, the film material composing the heat absorbing film diffuses on the surface of the conductive reflective film (metal diffusion), which may lower the luminous intensity of the fluorescent materials. Moreover, film formation by spray coating or the formation of aluminum oxide film at a low degree of vacuum has been suffering from a large lack of uniformity in the manufacturing, complicated management, and difficulty in obtaining heat absorbing film having stable characteristics.

SUMMARY OF THE INVENTION

According to the present invention, there is provided a method for manufacturing a cathode ray tube in which predetermined films are formed on an inner surface side of a panel having a fluorescent film formed thereon, comprising a first step for forming a conductive reflective film on the fluorescent film by depositing a first film material; a second step for forming a diffusion preventive film on the surface of the conductive reflective film formed on the fluorescent film; and a third step for forming a heat absorbing film on the diffusion preventive film formed on the conductive reflective film by depositing a second film material.

According to such method for manufacturing a cathode ray tube, in the process of forming the conductive reflective film using a first film material on the inner surface side of the panel and further forming thereon the heat absorbing film using a second film material, having the diffusion preventive film interposed therebetween, diffusion of such second film material on the conductive reflective film can successfully be prevented by the diffusion preventive film. This ensures desirable and stable characteristics and film qualities of the conductive reflective film and the heat absorbing film. In a cathode ray tube thus obtained, that is, in a cathode ray tube having on the inner surface side of the panel thereof a three-layered film comprising the conductive reflective film, the diffusion preventive film and the heat absorbing film, such diffusion preventive film allows the conductive reflective film and the heat absorbing film to fully exhibit their functions, which improves the display image quality.

In the case where the vacuum evaporation process is employed for the first and third steps in such method for manufacturing a cathode ray tube, the diffusion preventive film is obtained by oxidizing the surface of the conductive reflective film in a vacuum chamber used for the vacuum evaporation process after a degree of vacuum of the vacuum chamber is lowered at a predetermined level so that the conductive reflective film and the diffusion preventive film can be formed in the same vacuum chamber using a first film material only, and such diffusion preventive film can be formed by a simple process.

The conductive reflective film and the heat absorbing film can successively be formed within the same vacuum chamber by respectively supplying the first film material and the second film material to the separate heat sources, activating in the first step a heat source to which the first film material is supplied and activating in the third step another heat source to which the second film material is supplied.

According to the method for manufacturing a cathode ray tube of the present invention, the second film material composing the heat absorbing film will not diffuse on the conductive reflective film since the heat absorbing film is formed only after the diffusion preventive film is formed on the conductive reflective film after the formation thereof on the inner surface side of the panel. Such process can successfully form a conductive reflective film with excellent reflection characteristics (mirror effect) and a heat absorbing film with excellent heat absorption characteristics.

BRIEF DESCRIPTION OF THE DRAWINGS

The above and other objects, features and advantages of the present invention will become more apparent from the following description of the presently preferred exemplary embodiment of the invention taken in conjunction with the accompanying drawings, in which.

DESCRIPTION OF THE PREFERRED EMBODIMENT

An embodiment of the present invention will be detailed hereinafter referring to the attached drawings.

Figure 1:
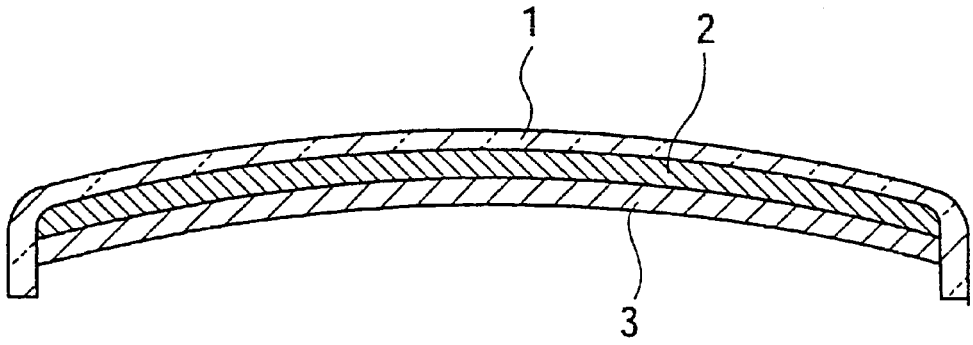
FIG. 1 is a schematic sectional view showing a conventional panel.
Figure 2:
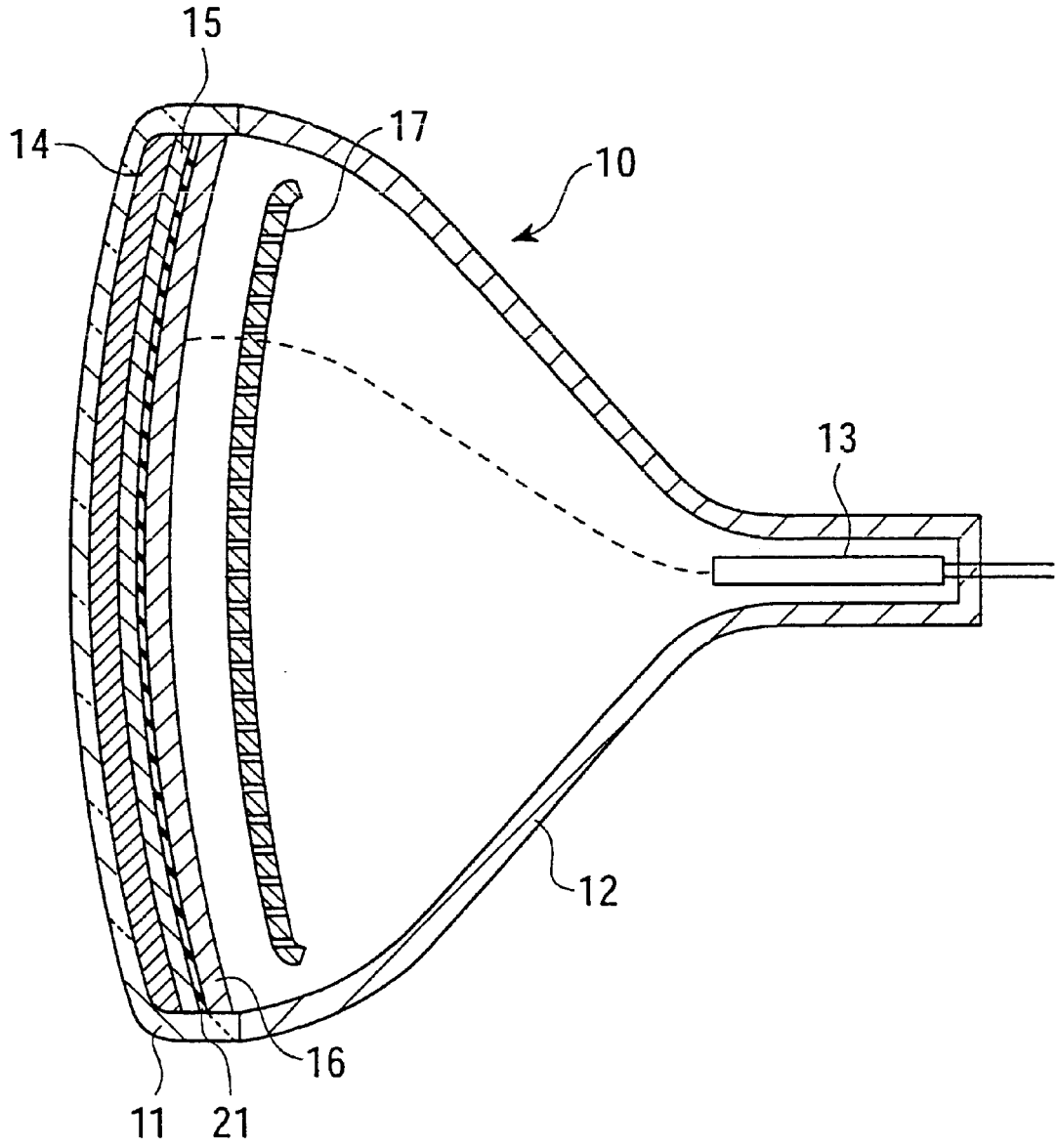
FIG. 2 is a lateral sectional view showing a cathode ray tube manufactured in accordance with the method of the present invention.

FIG. 2 shows a lateral sectional view showing a cathode ray tube of the present invention. In FIG. 2, a main body of a cathode ray tube 10 comprises a panel 11 made of glass and a funnel 12. The panel 11 and the funnel 12 are bonded into unity using a seal material (frit) while being opposed at the individual opening ends (seal edge planes). The neck portion of the funnel 12 accommodates therein electron guns for emitting electron beams. The panel 11 has on an inner surface thereof a fluorescent film 14 comprising red, green and blue fluorescent material layers formed in a predetermined pattern and a three-layered film comprising a conductive reflective film (metal back film) 15, a diffusion preventive film 21 and a heat absorbing film 16.

The main body of the cathode ray tube 10 has further incorporated therein a color selective mask (aperture grill, shadow mask, and the like) 17 constituting a color selective mechanism. The color selective mask 17 has a large number of slits or small holes for color selection, and is placed within the main body of the cathode ray tube 10 in the vicinity of the inner surface of the panel 11. Electron beams emitted from the electron gun 13 reach the inner surface of the panel 11 through the slits or small holes of the color selective mask 17, as indicated by a broken line in FIG. 2, which makes the fluorescent film 14 emit light.

Figure 3:
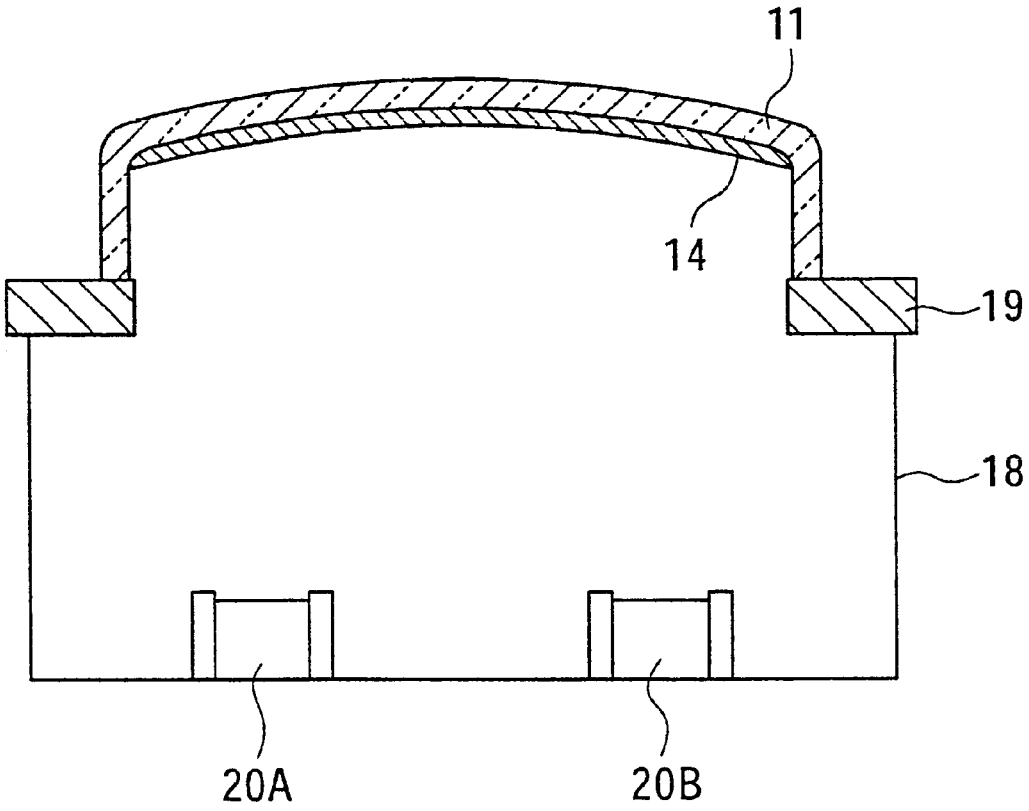
FIG. 3 is a schematic view showing a vacuum vapor deposition apparatus used for practicing the method of the present invention.

FIG. 3 is a schematic view showing a vacuum vapor deposition apparatus used for the method for manufacturing a cathode ray tube of the present invention. In FIG. 3, a vacuum chamber 18 has in the upper portion thereof a panel rest 19, on which the panel 11 is placed so as to direct the fluorescent film 14 formed on the inner surface thereof downward.

The vacuum chamber 18 is also provided therein two heater portions 20A and 20B as the heat sources. Such two heaters 20A and 20B are placed so as to oppose with the fluorescent film 14 formed on the inner surface of the panel 11 placed on the panel rest 19. Possible systems for heating the individual heater portions 20A and 20B (heat sources) include resistance heating, electron beam heating and radio frequency induction heating (high frequency induction heating). The arrangement and the number of the heat sources (heater portions) may arbitrarily be selected depending on the size or shape of the panel 11 as a target of the film formation.

The next paragraphs will describe, as an exemplary case of the method for manufacturing the cathode ray tube according to the present invention, procedures for forming the three-layered film comprising the conductive reflective film 15, the diffusion preventive film 21 and the heat absorbing film 16 on the inner surface side of the panel 11 having the fluorescent film 14 already formed thereon in accordance with the vacuum evaporation.

The panel 11 is placed on the panel rest 19, and the first film material and the second film material are separately supplied to the heater portions 20A and 20B, respectively. The first and second film materials are now placed in boats (crucibles) provided at the individual heater portions 20A and 20B.

The first film material now composes the conductive reflective film 15, and the second film material composes the heat absorbing film 16. Materials having large light reflectivity are available for such first film material, and materials having infrared absorbance higher than that of the first film material are available for such second film material. An exemplary case herein employs aluminum (pellet) as the first film material, and chromium (powder) as the second film material.

Next, the vacuum chamber 18 is evacuated with, for example, a vacuum pump, to thereby reduce the total pressure therein to a predetermined degree of vacuum (approx. $10^{-2}$ Pa, for example), and heater portion 20A is activated to thereby heat aluminum (first film material) supplied thereto.

Figure 4:
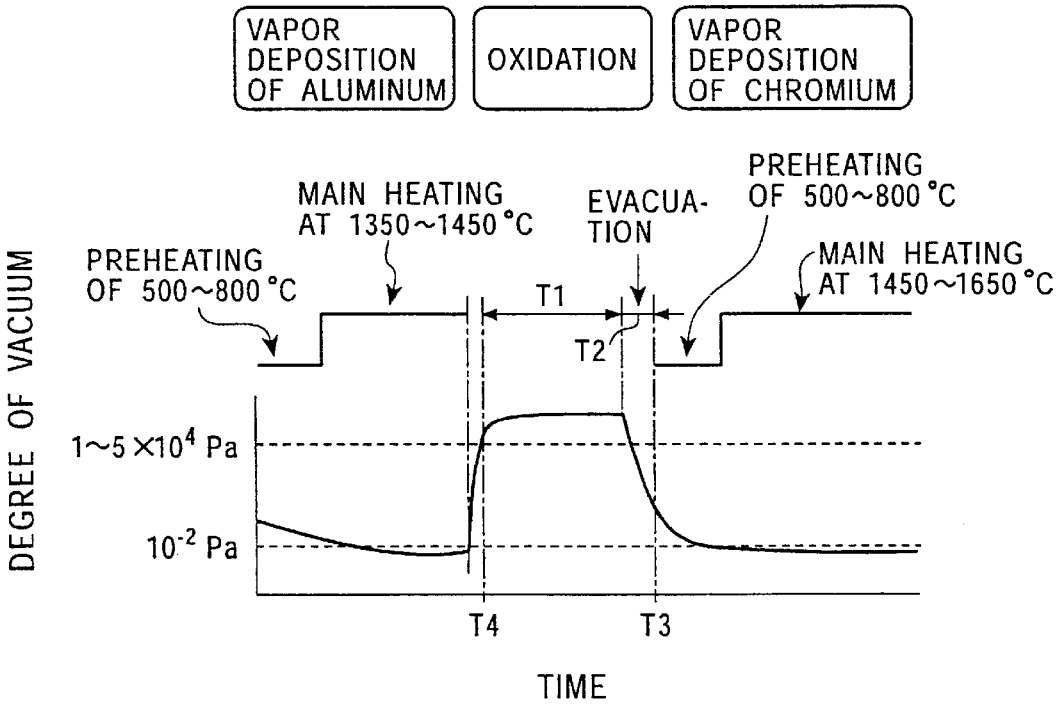
FIG. 4 is a chart showing a profile of the temperature and degree of vacuum during the vapor deposition in the embodiment.

FIG. 4 shows a chart showing a profile of the temperature and degree of vacuum during the vacuum evaporation. As is clear from FIG. 4, the vapor deposition process of aluminum includes preliminarily heating (preheating) for a predetermined time period (20 seconds, for example) and successive main heating for a predetermined time period (45 seconds, for example). The temperature during the preheating is set at a temperature (500 to 800° C.) lower than the boiling point of aluminum (980° C.) at the foregoing specific degree of vacuum, and the temperature during the main heating is set at a temperature (1,350 to 1,450° C.) higher than such boiling point of aluminum.

Heating aluminum using the heater portion 20A according to such temperature profile allows such aluminum to evaporate within the vacuum chamber 18 and to deposit (adhere) onto the inner surface side of the panel 11. The conductive reflective film 15 made of aluminum is thus formed on the fluorescent film 14 on the inner surface of the panel 11.

After the conductive reflective film 15 is formed, evacuation (with the aid of a vacuum pump, for example) of the vacuum chamber 18 is ceased, and the inner atmosphere thereof is allowed to leak with the external to thereby lower the degree of vacuum to a predetermined level. The degree of vacuum herein is typically set at 1 Pa to $5\times10^4$ Pa. Lowering the degree of vacuum in the vacuum chamber 18 allows air (oxygen) to be introduced into the vacuum chamber 18 during the leakage, and sustaining such state for a predetermined period (5 to 60 seconds, for example) successfully oxidizes the surface of the conductive reflective film 15. The diffusion preventive film 21 made of an oxide film (a film of aluminum oxide) is thus formed on the surface of the conductive reflective film 15.

In such lowering of the degree of vacuum in the vacuum chamber 18 to a predetermined level, it is now preferable to suppress the degree of vacuum at a minimum pressure (a possible highest vacuum level) required for forming the oxide film on the surface of the conductive reflective film 15. This is necessary for minimizing the time required for re-evacuation described next.

The vacuum chamber 18 is then re-evacuated to a predetermined degree of vacuum (approx. $10^{-2}$ Pa), and in such state of reduced pressure (high degree of vacuum), the heater portion 20B is activated to thereby heat chromium (second film material) supplied thereto. A temperature profile is shown herein in FIG. 4, in which the process starts with preheating for a predetermined duration (20 seconds, for example), and which is followed by main heating for a predetermined duration (45 seconds, for example). The temperature during the preheating is set at a temperature (500 to 800° C.) lower than the boiling point of chromium (1,170° C.) at the foregoing specific degree of vacuum, and the temperature during the main heating is set at a temperature (1,450 to 1,650° C.) higher than such boiling point of chromium.

Heating chromium using the heater portion 20B according to such temperature profile allows such chromium to vaporize within the vacuum chamber 18 and to deposit onto the inner surface side of the panel 11. The heat absorbing film 16 made of chromium is thus formed on the fluorescent film 14 on the conductive reflective film 15 as being interposed with the diffusion preventive film 21. Thus, the three-layered film comprising the conductive reflective film 15, diffusion preventive film 21 and the heat absorbing film 16 is thus formed on the inner surface side of the panel 11 having the fluorescent film 14 formed thereon.

In such method for manufacturing a cathode ray tube according to this embodiment in which the conductive reflective film 15 and the heat absorbing film 16 are formed on the inner surface side of the panel 11, the diffusion preventive film 21 is formed on the conductive reflective film 15 so that the heat absorbing film 16 is grown while always being interposed by the diffusion preventive film 21. The diffusion preventive film 21 can successfully prevent chromium from diffusing into the conductive reflective film 15 during vapor deposition of chromium onto the inner surface side of the panel 11. This improves the film quality and characteristics of the conductive reflective film 15 and thus avoids degradation of the luminous intensity. The vapor deposition of chromium onto the inner surface side of the panel 11 under a high degree of vacuum is also advantageous in achieving high film quality and characteristics of the heat absorbing film 16.

This successfully suppresses changes in the film structure depending on manufacturing conditions in the process steps after the film formation process (for example, heating temperature condition in a process for bonding the panel and the funnel in a frit sealing chamber (furnace)) and associative non-uniformity in the quality (for example, luminous intensity, color misalignment due to failure in the beam landing).

The diffusion preventive film 21 is obtained by oxidizing the surface of the conductive reflective film 15 after such conductive reflective film 15 is formed by depositing aluminum onto the inner surface side of the panel 11, so that such process is also advantageous in that both the conductive reflective film 15 and the diffusion preventive film 21 can be formed using only aluminum as a first film material, and the diffusion preventive film 21 can be formed by a simple procedure.

Aluminum and chromium are respectively supplied to the separate heater portions 20A, 20B, where the heater portion 20A supplied with aluminum is activated first and the heater portion 20B supplied with chromium is then activated. This allows successive formation of the conductive reflective film 15 and the heat absorbing film 16 within a single vacuum chamber 18. This also allows successive formation of the three-layered film, comprising the conductive reflective film 15, the diffusion preventive film 21 and the heat absorbing film 15, within a single vacuum chamber 18 in a single process cycle of vapor deposition. This successfully simplifies the manufacturing process (in particular, panel manufacturing process) and shortens the process time for the individual film formation and the total process time.

As shown in FIG. 4, reducing the degree of vacuum within the vacuum chamber 18 to a predetermined level (1 Pa to $5\times10^4$ Pa) and starting under such condition (within a period T1 in the figure) the vapor deposition (preheating) of chromium results in the formation of a layer of chromium oxide which can serve as the diffusion preventive film 21 on the conductive reflective film 15. The total process time can be shortened further by reducing process time T2 for the evacuation. The total process time can be shortened still further by setting a time point T3 for starting the chromium deposition in the early stage of period T1, where the degree of vacuum in the vacuum chamber 18 is kept at a low level (1 Pa to $5\times10^4$ Pa), and more preferably by setting as the same with a time point T4 where the degree of vacuum in the vacuum chamber 18 reaches such predetermined level.

Although the invention has been described in its preferred form with a certain degree of particularity, obviously many changes and variations are possible therein. It is therefore to be understood that many modifications can be practiced other than as specifically described herein without departing from the spirit and scope of the present invention. For example, while the foregoing embodiment employs aluminum and chromium as the first and second film materials, respectively, the present invention is by no means limited thereto and allows any combinations of other film materials (including even those other than metals). Possible second film materials include manganese, tin, nickel and boron.

What is claimed is:

1. A method for manufacturing a cathode ray tube in which predetermined films are formed on an inner surface side of a panel having a fluorescent film formed thereon, comprising:

a first step for forming a conductive reflective film on said fluorescent film by depositing by vacuum evaporation a first film material;

a second step for forming a diffusion preventive film on the surface of said conductive reflective film formed on said fluorescent film; and a third step for forming a heat absorbing film on said diffusion preventive film formed on said conductive reflective film by depositing by vacuum evaporation a second film material.

2. The method for manufacturing a cathode ray tube as claimed in claim 1, wherein said diffusion preventive film is obtained by oxidizing a surface of said conductive reflective film in a vacuum chamber used for the vacuum evaporation process after a degree of vacuum of said vacuum chamber is lowered to a predetermined level.

3. The method for manufacturing a cathode ray tube as claimed in claim 2, wherein the vacuum evaporation process of said second film material in the third step is initiated after the degree of vacuum in said vacuum chamber is lowered to the predetermined level.

4. The method for manufacturing a cathode ray tube as claimed in claim 1, wherein a vacuum chamber used for the vacuum evaporation process is provided with a plurality of heat sources to which said first film material and said second film material are respectively supplied, and one of said heat sources supplied with said first film material is activated in said first step, and the other of said heat sources supplied with said second film material is activated in said third step.

5. The method for manufacturing a cathode ray tube as claimed in claim 4, wherein said diffusion preventive film is obtained by oxidizing a surface of said conductive reflective film in said vacuum chamber used for the vacuum evaporation process after a degree of vacuum of said vacuum chamber is lowered to a predetermined level.

6. The method for manufacturing a cathode ray tube as claimed in claim 5, wherein the vacuum evaporation process of said second film material in the third step is initiated after the degree of vacuum of said vacuum chamber is lowered to the predetermined level.

* * * * *